United States Patent [19]

Perches et al.

[11] Patent Number: 4,783,874

[45] Date of Patent: Nov. 15, 1988

[54] ADJUSTABLE HEAD BRUSH

[75] Inventors: Robert Perches, Encino; Otto Osswald, Santa Monica; Erik M. Arnhem, Los Angeles, all of Calif.

[73] Assignee: Robert Perches & Associates, Inc., Encino, Calif.

[21] Appl. No.: 34,058

[22] Filed: Apr. 3, 1987

[51] Int. Cl.[4] ..... A46B 9/04

[52] U.S. Cl. ..... 15/167.1; 15/172

[58] Field of Search ..... 15/167 R, 167 A, 106, 15/DIG. 5, 201, 110, 111, 114, 172, 169

[56] References Cited

U.S. PATENT DOCUMENTS

| | | | |
|---|---|---|---|
| 13,244 | 6/1913 | Fordyce | 15/201 |
| 2,159,432 | 5/1939 | Enns | 15/201 X |
| 2,266,195 | 12/1941 | Hallock | 15/167 R |
| 2,435,394 | 2/1948 | Hawley | 15/201 |
| 3,680,169 | 8/1972 | Thompson | 15/176 |
| 4,409,701 | 10/1983 | Perches | 15/167 R |

*Primary Examiner*—Philip R. Coe
*Assistant Examiner*—K. L. O'Leary
*Attorney, Agent, or Firm*—Erik M. Arnhem

[57] ABSTRACT

An adjustable head toothbrush includes a one piece molded head and handle defining an interior cavity within the head portion. An integral molded hinge coupled member is supported within the cavity and is moveable in response to a moveable slide to elevate a portion of the assembly and alter the configuration of bristles within the toothbrush. In one embodiment, a slide is coupled to a link member by an arm and a pair of pivotal members are coupled to a moveable bristle support. In an alternate embodiment, a bristle support is hingeably coupled to a pivoting member which in turn is caused to pivot in accordance with the position of a moveable slide coupled to the toothbrush handle.

8 Claims, 2 Drawing Sheets

ADJUSTABLE HEAD BRUSH

FIELD OF THE INVENTION

This invention relates generally to brushes and particularly to those having means for altering the configuration of the bristles in the brush head.

BACKGROUND OF THE INVENTION

A number of toothbrush structures have been created over the years providing a variable head configuration whereby the bristles arrangement or relative heights is altered to facilitate different brushing requirements.

U.S. Pat. No. 3,683,442 issued to James A. Holly on Aug. 15, 1972 sets forth a toothbrush having a plurality of individual brush elements which are spring biased into an upright position and which adapts to configure the brush to conform to the tooth surfaces.

U.S. Pat. No. 726,716 issued to D. F. Maher on Apr. 28, 1903 sets forth a toothbrush having a moveable center row of bristles supported within a center groove by a guide strip.

U.S. Pat. No. 4,488,328 issued to Richard M. Hyman on Dec. 18, 1984 sets forth a toothbrush having a floating head structure in which a yoke structure supports an elongated brush head by means of a resilient element which spring biases the pivotal motion of the elongated head element.

U.S. Pat. No. 4,633,542 issued to Bernard Taravel on Jan. 6, 1987 sets forth a brush having resiliently retractable bristles in particular for brushing surfaces of complex shapes such as teeth. A plurality of bristle tufts are resiliently retractable by thrusting against a membrane which is capable of resilient deformation. Each tuft is independently moveable with respect to the other tufts within the brush such that the combination of tufts adapts to the shape of the surface to be brushed.

U.S. Pat. No. 2,266,195 issued to R. L. Hallock on Dec. 16, 1941 sets forth a toothbrush having a center portion of the head being independently moveable with respect to the remaining portions of the brush head and being coupled to the handle by a resilient beam spring member.

U.S. Pat. No. 3,082,457 issued to F. R. Lucibello et al on Mar. 26, 1963. A self adapting tuft for brushes is set forth in which a plurality of recesses within the toothbrush head receive a corresponding plurality of brush tufts which are supported within the recesses by a resilient membrane and which permit the individual tufts within the brush head to move in order to accommodate the shape of the structure being brushed.

U.S. Pat. No. 2,435,394 issued to J. P. Hawley on Feb. 3, 1948 for an adjustable toothbrush sets forth a toothbrush having a moveable center row of bristles, the lateral position of which may be adjusted to be aligned with or offset from the remaining bristle structures in the toothbrush head.

U.S. Pat. No. 2,706,825 issued to A. R. Blakeman on Apr. 26, 1955 for a toothbrush sets forth a toothbrush having a removeable bristle structure supported upon an elastic deformable flexible bristle membrane.

U.S. Pat. No. 2,443,297 issued to L. R. Bressler on June 15, 1948 for a toothbrush in which the head structure is segemented and which is secured to the handle by a resilient spring member. U.S. Pat. No. 2,864,111 issued to C. Rotceig on Dec. 16, 1958 sets forth toothbrushes in which a flexible head structure insert supports a plurality of bristle tufts and which is deformably secured within the head.

U.S. Pat. No. 4,140,452 issued to San Bau Jean on Dec. 23, 1980 sets forth an elastic base toothbrush in which a toothbrush head defines a recess supporting a plurality of elastic members and an overlying bristle structure. The elastic members deform during the brushing process and permit the bristles to flex in use and thereby conform to the surface being brushed.

While the foregoing described prior art toothbrushes provide some benefits of variably configured heads, they are often difficult to manufacture and are equally often difficult to operate in use due to the complexities of the mechanisms used to configure the toothbrush heads.

One structure set forth in U.S. Pat. No. 4,409,701 issued to Robert Perches on Oct. 18, 1983 sets forth a toothbrush having a center bristle arrangement which is elevated by a slideable wedge.

SUMMARY OF THE INVENTION

Accordingly, it is a general object of the present invention to provide an improved toothbrush structure. It is a more particular object of the present invention to provide an improved toothbrush structure in which a simple integral operating mechanism is utilized to alter the configuration of the toothbrush head during use. It is a still more particular object of the present invention to provide an adjustable head toothbrush in which a single molded element operates the adjustable head.

In accordance with the invention, there is provided an adjustable head toothbrush having a moveable row of bristles adjacent to at least one or more rows of bristles which is operable between a first position in which the moveable row of bristles is raised with respect to the surrounding rows of bristles and a second retracted position in which the moveable row of bristles is substantially aligned with the surrounding bristle rows. The support for the moveable row of bristles and the mechanism raising and lowering it are formed of an integral one-piece molded unit.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
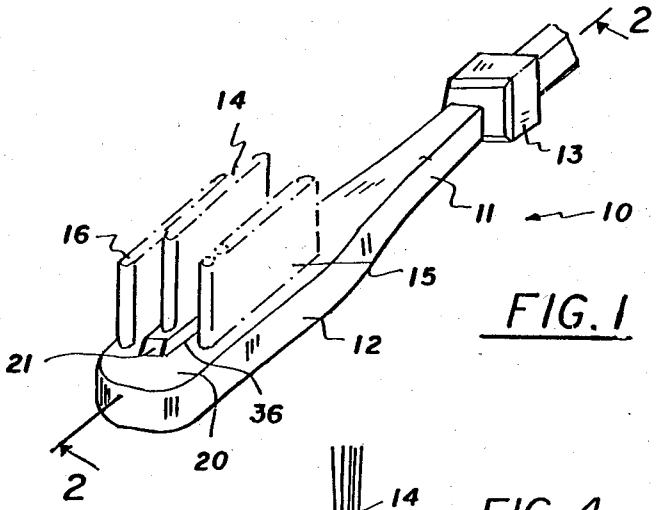
FIG. 1 is a perspective view of an adjustable head toothbrush constructed in accordance with the present invention.

FIG. 1 sets forth a perspective view of the present invention toothbrush in which a generally elongated head 12 and an elongated narrow handle 11 are molded from a common piece of plastic material. A surface 20 supports a pair of outer rows of bristles 15 and 16 in accordance with generally accepted toothbrush fabrication techniques. Bristles 15 and 16 are in the preferred form, gathered into tufts and molded into head 12. Head 12 further defines an elongated channel 36 (better seen FIG. 4). An elongated bristle support 21 is fitted within channel 36 and supports a center bristle row 14. A slide member 13 is secured to and travels upon handle 11. In accordance with means set forth below in greater detail, slide 13 is coupled to bristle support 21 such that slide 13 is moveable between the position shown in FIG. 1 in which slide 13 is positioned closer to head 12 thereby raising bristle support 21 to the raised position shown in FIG. 1 and a second position farther from head 12 by a predetermined distance (better seen in FIG. 3). In its second position, the coupling means of slide 13 and bristle support 21 cause bristle support 21 and thereby center bristle 14 to be displaced downwardly from the position shown in FIG. 1 thereby lowering center bristle 14 until it is substantially even with bristles 15 and 16.

Figure 2:
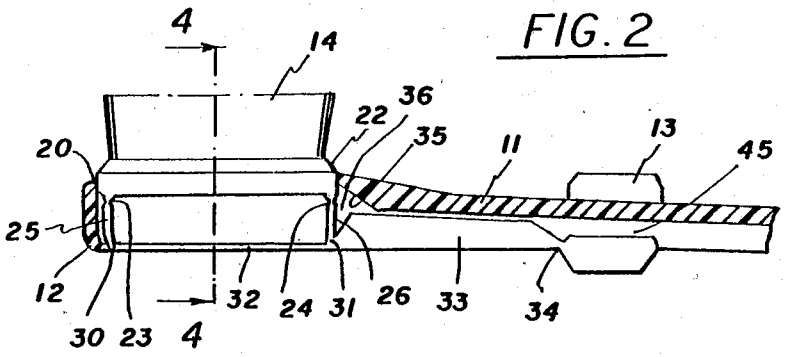
FIG. 2 is a section view of an adjustable head toothbrush constructed in accordance with the present invention taken along section lines 2—2 in FIG. 1.

FIG. 2 sets forth a section view of the present invention adjustable head toothbrush taken along section lines 2—2 in FIG. 1. As can be seen, head 12 defines an elongated channel 36 extending upwardly and receiving bristle support 21. Handle 11 further defines a slot 45 extending from channel 36 and in communication therewith through the remainder of handle 11 and beyond the position of slide 13.

Figure 5:
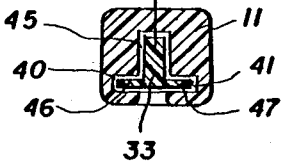
FIG. 5 is a section view of the present invention adjustable head toothbrush taken along section lines 5—5 in FIG. 3.

Bristle support 21 further defines an incline 22, the function of which is set forth below in greater detail. A pair of members or pivot arms 25 and 26 are joined to the ends of bristle support 21 at a pair of hinges 23 and 24 respectively. An elongated flat link 32 is joined to the other ends of members 25 and 26 by a pair of hinges 30 and 31 respectively. An elongated arm 33 having a cross-section better seen in FIG. 5, is coupled between slide 13 and link 32 by a hinge 34 and a hinge 31 respectively. In accordance with an important aspect of the present invention, support 21, members 25 and 26, link 32, arm 33 and slider 13 as well as hinges 23, 24, 30 and 31 and hinge 34 are molded from a single integral plastic member.

In operation, with slide 13 positioned upon handle 11 in the position shown in FIG. 2, arm 33 positions link 32 directly beneath bristle support 21 thereby raising members 25 and 26 to their vertical positions. The vertical positioning of members 25 and 26 supports bristle support 21 in a raised position extending from channel 36 within head 12 of toothbrush 10. In this position, center bristles 14 are raised above bristles 15 and 16.

Figure 3:
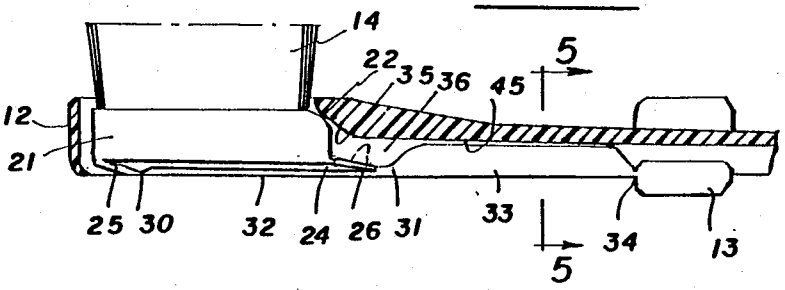
FIG. 3 is an alternate view of the present invention adjustable head toothbrush in which the center bristle configuration is lowered with respect to the adjacent rows of bristles.

FIG. 3 sets forth the configuration of the present invention toothbrush in which slider 13 has been moved upon handle 11 to a second position farther from head 12 such that bristles 14 are lowered into the body of head 12. Accordingly, with slides 13 moved from head 12, arm 33 is drawn to the right within slot 45 which in turn draws link 32 to the right within channel 36. The rightward movement of link 32 causes members 25 and 26 to be drawn downwardly through the coupling of hinges 30 and 31 respectively. Support 21 is drawn downwardly by the pivoting of members 25 and 26. As a result, bristle support 21 assumes the position shown in FIG. 3. It should be noted that channel 36 defines an internal inclined surface 35 while bristle support 21 defines an inclined surface 22. Thus, when slider 13 is drawn to the right, that is farther from head 12, bristle support 21 is lowered carrying bristles 14 downwardly through their lowered position.

From the position shown in FIG. 3, movement to the left of slide 13 upon handle 11 creates a lateral force which is coupled by arm 33 to link 32 and which drives arm 33 to the right which in turn raises and pivots members 25 and 26 about hinges 30 and 31 respectively. The pivoting of members 25 and 26 forces bristle support 21 upwardly. The upward force upon bristle support 21 causes inclined surface 22 to be driven against surface 35 of head 12. The cooperation of surfaces 22 and 35 causes bristle support 21 to be moved upwardly and to the left until members 25 and 26 have again pivoted to the vertical position shown in FIG. 2 and bristle support 21 has again raised center bristles 14.

In accordance with an important aspect of the present invention, the position of bristle support 21 in its raised position is locked by continued motion of slide 13 and thereby arm 33 and link 32 to move members 25 and 26 to a slightly "over center" motion such that hinges 30 and 31 are positioned slightly to the left of hinges 23 and 24 respectively. With this over center motion, downward forces which occur during brushing upon bristle 14 and bristle support 21 are resisted by members 25 and 26.

Figure 4:
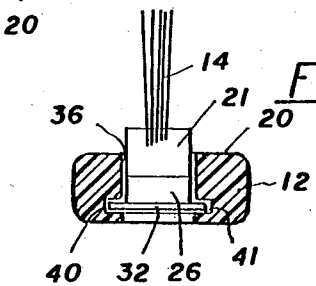
FIG. 4 is a section view of a portion of the present invention adjustable head toothbrush taken along section lines 4—4 in FIG. 2.

FIG. 4 shows a section view of the present invention toothbrush taken along section lines 4—4 in FIG. 2 in which channel 36 was shown including a pair of lateral grooves 40 and 41 extending outwardly from the interior of channel 36. Link 32 defines a substantially planar member which extends beyond channel 36 and is carried within grooves 40 and 41. The extension of link 32 into grooves 40 and 41 secures the position of link 32 within head 12. Member 26 is shown in its raised position supporting bristle support 21.

FIG. 5 sets forth a section view of handle 11 taken along section lines 5—5 in FIG. 3. As can be seen, handle 11 defines a vertical slot 45. As can also be seen, grooves 40 and 41 extend beyond channel 36 and receive the outwardly extending portions of arm 33. Arm 33 is shown to have a generally T-shaped cross-section in which a center rib 44 extends upwardly and is received within a slot 45 defined within handle 11 and edges 46 and 47 are received within grooves 40 and 41. The position of rib 44 within slot 45 serves to maintain the positioning of arm 33 within handle 11. Thus, arm 33 is slideably moveable within handle 11.

Figure 6:
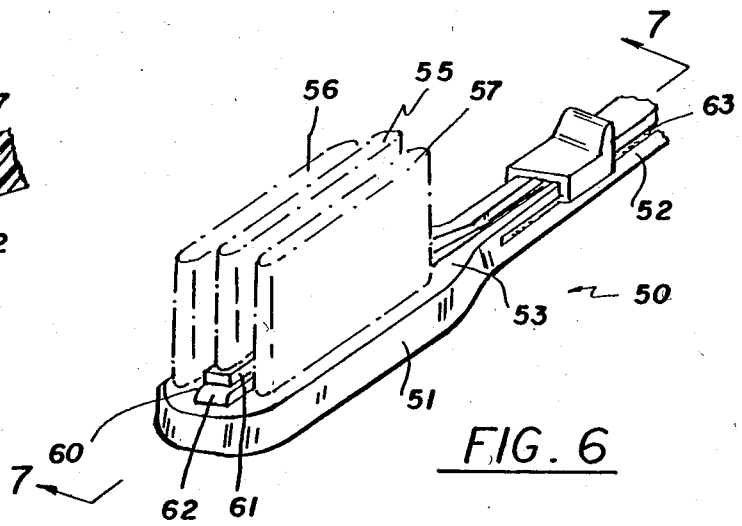
FIG. 6 is a perspective view of an alternate embodiment of the present invention adjustable head toothbrush.
Figure 7:
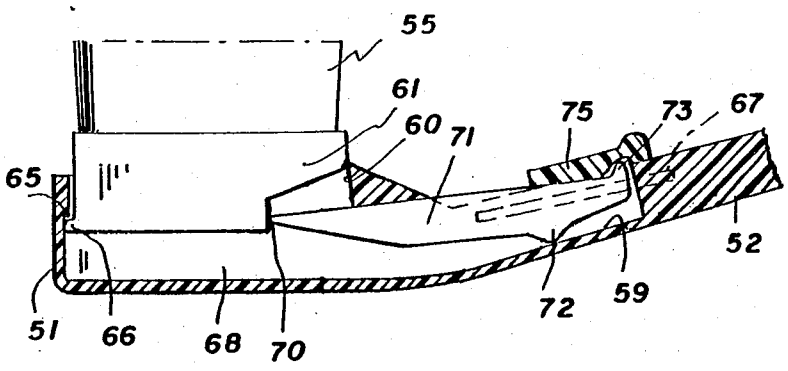
FIG. 7 is a section view of the alternate embodiment of FIG. 6 taken along section lines 7—7.
Figure 8:
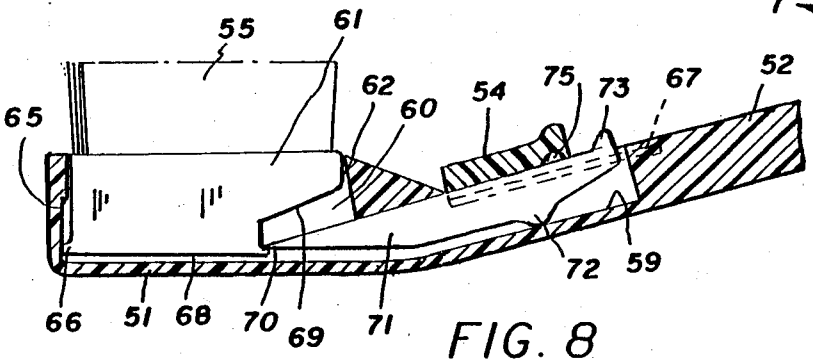
FIG. 8 is a section view of the alternate embodiment of FIG. 6 showing the center row of brushes being raised from the surrounding bristles.

FIG. 6 together with FIGS. 7 and 8 set forth an alternate embodiment 50 of the present invention. Specifically, FIG. 6 sets forth a perspective view of the alternate embodiment of the present invention in which a head 51 and a handle 52 are preferably molded from a common plastic member. A slide 54 is moveably supported upon handle 52. A pair of bristle rows 56 and 57 are moldably supported within head 51 in accordance with generally accepted fabrication techniques and extend upwardly from a surface 53 of head 51. Handle 52 defines a groove 63 extending along handle 52 from its junction with head 51. Handle 52 further defines a corresponding groove 67 (seen in dashed line representation in FIGS. 7 and 8) which is identical to groove 63. A slide 54 defines a substantially U-shaped channel member having an inwardly extending lip 64 which extends into and is received within groove 63. Slide 54 further defines an identical lip to lip 64 (not shown) which extends into and is received by groove 67. In accordance with the invention, slide 54 is moveable upon handle 52 and secured thereto by the cooperation of the inwardly extending lip portions and grooves 63 and 67.

Head 51 further defines an elongated channel 60 centered between bristles 56 and 57. A guide member 62 surrounds channel 60 and is raised above surface 53 of head 51. A bristle support 61 is received and supported within channel 60 and supports a center bristle 55. Bristles 55 are secured within bristle support 61 in accordance with conventional molded fabrication techniques.

It should be noted that bristles 55, 56, and 57 are shown in outline form to reveal the structures of guide 62, channel 60, and bristle support 61. It will be apparent, however, to those skilled in the art that the structures of bristles 55, 56, and 57 are in accordance with conventional bristle fabrications which in their preferred form comprise a linear arrangement of discrete bristle tufts spaced closely together to form a linear bristle array. In the position shown, center bristle 55 is raised above bristles 56 and 57 by the cooperation set forth below in greater detail of slide 54 and support 61. As will be set forth below in greater detail, slide 54 is moveable with respect to handle 52 to permit support 61 and thereby center bristle 55 to be lowered to a position substantially even with bristles 56 and 57.

FIG. 7 sets forth a section view of the alternate embodiment of the present invention toothbrush of FIG. 6 taken along section lines 7—7. Head 51 defines an interior cavity 68 extending the entire length of head 51 and into the interior of handle 52. Head 51 further defines an interior channel 60 which in turn defines a inwardly extending stop 65. Bristle support 61 defines a generally rectangular member having an outwardly extending tab 66. Bristle support 61 further defines an inclined surface 69 and a hinge member 70. A pivot arm 71 defines a generally elongated member secured to bristle support 61 at hinge 70 on one end and terminating in an upwardly extending stop 73 at the other end. A downwardly extending pivot 72 abutts surface 59 of cavity 68 and forms a fulcrum about which pivot arm 71 pivots. As mentioned, handle 52 defines an elongated groove 67 shown in dashed line representation. Slide 54 defines an interior recess 75 extending upwardly within the body of slide 54. As mentioned, FIG. 7 sets forth the section view of the embodiment of FIG. 6 in which center bristle 55 is in the raised position. As can be seen in FIG. 7, slide 54 is positioned back from or to the right from head 51 such that stop 73 is captivated within recess 75. As can be seen in this position, the captivation of stop 73 causes pivot arm 71 to pivot about pivot 72 which in turn forces bristle support 61 to the upward extending position shown in FIG. 7. Further, the captivation of stop 73 within recess 75 of slide 54 secures the upwardly extending position of pivot arm 71 and bristles 55.

FIG. 8 sets forth the section view shown in FIG. 7 in which slide 54 has been moved to the position shown closer to head 51. As can be seen, the movement of slide 54 to the forward position (to the left in FIG. 8) releases stop 73 from recess 75. In addition, the contact of surface 58 of slide 54 upon pivot arm 71 causes pivot arm 71 to pivot about pivot 72 in the counterclockwise direction thereby causing hinge 70 to be moved downwardly within cavity 68 of head 51. The downward motion of hinge 70 in turn draws support 61 downwardly within channel 60 thereby lowering bristle 55 to its lowered position.

Accordingly, slide 54 is moveable between the two positions depicted in FIGS. 7 and 8 and movement of slide 54 produces the corresponding rotation or pivoting of pivot arm 71 which in turn raises or lowers bristle support 61 within channel 60. In accordance with an important aspect of the present invention, support 61, hinge 70 and pivot arm 71 are molded of a single integral plastic member. As a result, the embodiment of FIG. 6 contains a minimum of moving parts and a minimum of assembly efforts are required.

What has been shown is an adjustable head toothbrush in which an integral molded combination member is operative in response to a movement of a slide member to configure the bristles within the toothbrush head to alternate configurations.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. An adjustable head brush comprising:

a brush body having a head portion and a handle portion, said head portion defining a brush surface, an internal cavity and channel in communication therewith;

a first plurality of bristles adjacent said channel extending upwardly from said brush surface;

a moveable bristle support supporting a second plurality of bristles and being received within said channel;

support means coupled to said moveable bristle support operative to support said moveable bristle support in a raised position in which said second plurality of bristles extend upwardly beyond said first plurality of bristles, and a lower position in which said second plurality of bristles are generally even with said first plurality; and slide means coupled to said support means and slideably supported upon said handle portion, said support means operative in response to movement of said slide means, said moveable bristle support and said support means formed of a single molded member including an integral hinge coupling said moveable bristle support to said support means and said support means including an elongated pivot arm having a first end coupled to said moveable bristle support and a second end cooperating with said slide means and a pivot extension intermediate said first and second ends, said slide means operative to pivot said pivot arm.

2. An adjustable head brush as set forth in claim 1 wherein said moveable bristle support comprises a generally rectangular member.

3. An adjustable head brush as set forth in claim 1 wherein said slide means defines an internal recess and wherein said pivot arm defines an upwardly extending stop member, said upwardly extending stop member and said internal recess cooperating to retain said pivot arm in the position of rotation producing upward positioning of said moveable bristle support.

4. An adjustable head brush comprising:

a brush body having a head portion and a handle portion, said head portion defining a brush surface, an internal cavity and channel in communication therewith;

a first plurality of bristles adjacent said channel extending upwardly form said brush surface;

a moveable bristle support defining an elongated rectangular member having first and second ends and supporting a second plurality of bristles and being received within said channel;

support means having a pair of pivot arms hingeably coupled to said first and second ends of said moveable bristle support operative to support said moveable bristle support in a raised position in which said second plurality of bristles extend upwardly beyond said first plurality of bristles, and a lower position in which said second plurality of bristles are generally even with said first plurality, said pair of pivot arms moving to an over-center position in said raised position tending to lock said moveable bristle support in said raised position; and slide means coupled to said support means and slideably supported upon said handle portion, said support means operative in response to movement of said slide means, said moveable bristle support and said support means formed of a single molded member including an integral hinge coupling said moveable bristle support to said support means.

5. An adjustable head brush as set forth in claim 4 wherein said support means further include an elongated link member coupled to said pair of pivot arms and an arm member having a first end coupled to said link member and a second end, and a slide member supported by said handle portion coupled to said second end of said arm member.

6. An adjustable head brush as set forth in claim 5 wherein said moveable bristle support, said pair of pivot arms and said link member form a parallelogram.

7. An adjustable head brush comprising:

a brush body having a head portion defining an internal cavity and a handle portion defining an internal channel;

an elongated aperture extending into said internal channel;

a plurality of bristles adjacent said elongated aperture;

a rectangular bristle support received within said internal channel having first and second ends;

a first pivot arm having a first end hingeably coupled to said first end of said rectangular bristle support;

a second pivot arm having a first end hingeably coupled to said second end of said rectangular bristle support;

an elongated link coupled to said second ends of said first and second pivot arms;

an elongated arm having a first end coupled to said elongated link and a second end;

a slide moveably supported upon said handle portion hingeably coupled to said second end of said elongated arm; and said bristle support, said first and second pivot arms, said elongated link, said elongated arm and said slide being formed of a single molded member.

8. An adjustable head brush comprising:

a stationary member supporting a first plurality of bristles; and a moveable member supporting a second plurality of bristles and defining a hinged movement means having a slide member and a pair of parallel pivot arms hingeably coupled to said moveable member and said slide member and being formed of a single molded unit cooperating to vary the relative positions of said first and second pluralities of bristles.

* * * * *